US011819810B2

(12) United States Patent
Luharuka et al.

(10) Patent No.: US 11,819,810 B2
(45) Date of Patent: Nov. 21, 2023

(54) MIXING APPARATUS WITH FLUSH LINE AND METHOD

(71) Applicant: SCHLUMBERGER TECHNOLOGY CORPORATION, Sugar Land, TX (US)

(72) Inventors: Rajesh Luharuka, Katy, TX (US); Gocha Chochua, Sugar Land, TX (US); Hau Nguyen-Phuc Pham, Houston, TX (US); Mark Ayyad, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 477 days.

(21) Appl. No.: 14/192,838

(22) Filed: Feb. 27, 2014

(65) Prior Publication Data

US 2015/0238913 A1 Aug. 27, 2015

(51) Int. Cl.
*B01F 23/53* (2022.01)
*B01F 25/53* (2022.01)
(Continued)

(52) U.S. Cl.
CPC ..... *B01F 23/53* (2022.01); *B01F 25/53* (2022.01); *B01F 25/85* (2022.01); *B01F 27/192* (2022.01); *B01F 27/8111* (2022.01)

(58) Field of Classification Search
CPC ..... B01F 5/106; B01F 7/00641; B01F 25/53; B01F 27/192
(Continued)

(56) References Cited

U.S. PATENT DOCUMENTS 559,965 A 5/1896 Bierstadt
896,233 A 8/1908 McQueen
(Continued)

FOREIGN PATENT DOCUMENTS

CA 2643743 C 4/2011
CN 2601189 Y 1/2004
(Continued)

OTHER PUBLICATIONS

International Search Report and Written Opinion issued in PCT/US2015/017175 dated May 28, 2015; 16 pages.
(Continued)

*Primary Examiner* — Marc C Howell
(74) *Attorney, Agent, or Firm* — Jeffrey D. Frantz

(57) ABSTRACT

A mixer and method for mixing are provided. The mixer includes a housing including a fluid inlet, an additive inlet, and an outlet. The housing defines a mixing chamber in fluid communication with the fluid inlet, the additive inlet, and the outlet. The mixer also includes an impeller disposed in the mixing chamber. When rotated, the impeller pumps fluid through the fluid inlet. The mixer also includes a slinger disposed in the mixing chamber and configured to receive the fluid from the impeller and to receive an additive from the additive inlet. When rotated, the slinger slings the fluid and the additive radially outwards. The mixer further includes a flush line extending between the mixing chamber and the additive inlet. The flush line is receives, from the mixing chamber, a portion of the fluid pumped by the impeller and to deliver the portion of the fluid to the additive inlet.

21 Claims, 10 Drawing Sheets

(51) Int. Cl.
*B01F 25/85* (2022.01)
*B01F 27/192* (2022.01)
*B01F 27/81* (2022.01)

(58) Field of Classification Search
USPC ..... 366/138
See application file for complete search history.

(56) References Cited

U.S. PATENT DOCUMENTS 1,526,527 A 2/1925 Butler
1,560,826 A 11/1925 Kirschbraun
1,576,940 A 3/1926 Arthur
2,073,652 A 3/1937 Robb
2,099,898 A 11/1937 Larkin
2,357,583 A 9/1944 Franco
2,735,839 A 2/1956 Schrenk
2,774,497 A 12/1956 Martin
2,792,262 A 5/1957 Hathorn
2,858,950 A 11/1958 Martin
3,155,248 A 11/1964 Haller
3,170,560 A 2/1965 Obmascher
3,208,616 A 9/1965 Haskins
3,263,436 A 8/1966 Goldfarb
3,314,557 A 4/1967 Sackett
3,378,152 A 4/1968 Warner et al.
3,394,961 A 7/1968 Matte
3,451,986 A 6/1969 Metais
3,490,632 A 1/1970 McKinney
3,497,327 A 2/1970 Kehse
3,560,053 A 2/1971 Ortloff
3,618,801 A 11/1971 Blanchard
3,666,129 A 5/1972 Haskins
3,687,319 A 8/1972 Adam et al.
3,743,108 A 7/1973 Visser
3,756,443 A 9/1973 Verschage et al.
3,787,479 A 1/1974 Oriehl et al.
3,842,910 A 10/1974 Zingg et al.
3,883,019 A 5/1975 Hansen, Jr.
3,883,148 A 5/1975 Miller
3,894,645 A 7/1975 Verschage
3,938,673 A 2/1976 Perry, Jr.
3,974,602 A 8/1976 Pohl et al.
3,985,254 A 10/1976 Grandury
3,998,433 A 12/1976 Iwako
4,026,441 A 5/1977 Jones
4,077,612 A * 3/1978 Ricciardi ..... B01F 1/00 366/102
4,079,150 A 3/1978 Beck et al.
4,090,623 A 5/1978 Noyon
4,099,005 A * 7/1978 Fullington ..... B01F 23/50 544/190
4,103,793 A 8/1978 Weaver
4,111,314 A 9/1978 Nelson
4,178,117 A 12/1979 Brugler
4,187,047 A 2/1980 Squifflet, Sr.
4,209,278 A 6/1980 Cooper et al.
4,222,498 A 9/1980 Brock
4,248,359 A 2/1981 Brock
4,249,848 A 2/1981 Griffin et al.
4,268,208 A 5/1981 Hankins et al.
4,337,014 A 6/1982 Farnham
4,348,146 A 9/1982 Brock
4,373,857 A 2/1983 Giles
4,375,343 A 3/1983 Butler
4,400,126 A 8/1983 Desourdy
4,427,133 A 1/1984 Kierbow et al.
4,453,829 A 6/1984 Althouse
4,465,420 A 8/1984 Dillman
4,494,903 A 1/1985 Badicel et al.
4,561,821 A 12/1985 Dillman
4,579,496 A 4/1986 Gerlach
4,601,628 A 7/1986 Lowing
4,621,972 A 11/1986 Grotte
4,624,357 A 11/1986 Oury et al.
4,626,166 A 12/1986 Jolly
4,671,665 A * 6/1987 McIntire ..... B01F 5/226 366/164.6
4,701,095 A 10/1987 Berryman et al.
4,775,275 A 10/1988 Perry
4,808,004 A 2/1989 McIntire et al.
4,832,561 A 5/1989 Nijenhuis
4,834,542 A * 5/1989 Sherwood ..... B01F 7/1625 366/21
4,850,750 A 7/1989 Cogbill et al.
4,855,960 A 8/1989 Janssen et al.
4,883,363 A 11/1989 Pillon et al.
4,899,832 A 2/1990 Bierscheid, Jr.
4,907,712 A 3/1990 Stempin
4,917,560 A 4/1990 Murray et al.
4,925,358 A 5/1990 Cook
4,944,646 A 7/1990 Edwards et al.
5,006,034 A 4/1991 Bragg et al.
5,018,932 A 5/1991 Croisier
5,035,269 A 7/1991 Pytryga et al.
5,046,856 A 9/1991 McIntire
5,052,486 A 10/1991 Wilson
5,121,989 A 6/1992 Horton et al.
5,190,374 A 3/1993 Harms et al.
5,195,861 A 3/1993 Handke
5,201,498 A 4/1993 Akins
5,236,261 A 8/1993 Hagenbuch
5,339,996 A 8/1994 Dubbert et al.
5,362,193 A 11/1994 Milstead
5,382,411 A 1/1995 Allen
5,387,736 A 2/1995 Salomone et al.
5,413,154 A 5/1995 Hurst, Jr. et al.
5,426,137 A 6/1995 Allen
5,427,497 A 6/1995 Dillman
5,571,281 A * 11/1996 Allen ..... B01F 3/12 366/163.1
5,667,298 A 9/1997 Musil et al.
5,685,416 A 11/1997 Bonnet
5,775,713 A 7/1998 Peterson et al.
5,777,234 A 7/1998 Kosmal
5,785,421 A 7/1998 Milek
5,795,062 A 8/1998 Johnson
5,822,930 A 10/1998 Klein
5,964,566 A 10/1999 Stewart et al.
6,000,840 A 12/1999 Paterson
6,050,743 A 4/2000 Medinger
6,186,195 B1 2/2001 Anstotz
6,186,654 B1 2/2001 Gunteret, Jr. et al.
6,193,402 B1 2/2001 Grimland et al.
6,286,986 B2 9/2001 Grimland et al.
6,293,689 B1 9/2001 Guntert, Jr. et al.
6,447,674 B1 9/2002 Simon et al.
6,474,926 B2 11/2002 Weiss
6,491,421 B2 12/2002 Rondeau et al.
6,527,428 B2 3/2003 Guntert, Jr. et al.
6,832,851 B1 12/2004 von Wilcken
6,939,031 B2 9/2005 Pham et al.
6,948,535 B2 9/2005 Stegemoeller
7,048,432 B2 5/2006 Phillippi et al.
7,104,328 B2 9/2006 Phillippi et al.
7,214,028 B2 5/2007 Boasso et al.
7,258,522 B2 8/2007 Pham et al.
7,308,953 B2 12/2007 Barnes
7,419,296 B2 9/2008 Allen
7,424,943 B2 9/2008 Gausman et al.
7,540,308 B2 6/2009 Pessin et al.
7,614,451 B2 11/2009 Blaschke et al.
7,703,518 B2 4/2010 Phillippi et al.
7,815,222 B2 10/2010 Markham
7,836,949 B2 11/2010 Dykstra
7,837,427 B2 11/2010 Beckel et al.
7,841,394 B2 11/2010 McNeel et al.
7,845,413 B2 12/2010 Shampine et al.
7,866,881 B2 1/2011 El Kholy et al.
7,921,914 B2 4/2011 Bruins et al.
7,926,564 B2 4/2011 Phillippi et al.
7,931,088 B2 4/2011 Stegemoeller et al.
8,066,955 B2 11/2011 Pinchot
8,083,083 B1 12/2011 Mohns

(56) References Cited

U.S. PATENT DOCUMENTS 8,127,844 B2 3/2012 Luharuka et al.
8,137,051 B2 3/2012 Glenn et al.
8,142,134 B2 3/2012 Lavoie et al.
8,146,665 B2 4/2012 Neal
8,313,269 B2 11/2012 Fisher et al.
8,354,602 B2 1/2013 Lucas et al.
8,585,341 B1 11/2013 Oren et al.
8,651,792 B2 2/2014 Friesen
8,661,743 B2 3/2014 Flusche
8,726,584 B1 5/2014 Nolte et al.
8,734,081 B2 5/2014 Stegemoeller et al.
8,834,012 B2 9/2014 Case et al.
8,926,252 B2 1/2015 McIver et al.
8,931,996 B2 1/2015 Friesen et al.
8,944,740 B2 2/2015 Teichrob et al.
9,017,001 B1 4/2015 Dueck
9,097,033 B2 8/2015 Margevicius et al.
9,457,335 B2 10/2016 Pham et al.
9,475,029 B2 10/2016 McSpadden et al.
9,663,303 B2 5/2017 Waldner et al.
9,688,178 B2 6/2017 Pham
2002/0034120 A1 3/2002 Guntert, Jr. et al.
2002/0147370 A1 10/2002 Hinz et al.
2003/0150494 A1 8/2003 Morgan et al.
2003/0161212 A1 8/2003 Neal et al.
2003/0196809 A1 10/2003 Willberg et al.
2003/0202869 A1 10/2003 Posch
2003/0227817 A1 12/2003 Martel et al.
2004/0008571 A1 1/2004 Coody et al.
2004/0209780 A1 10/2004 Harris et al.
2004/0256106 A1 12/2004 Phillippi et al.
2005/0028979 A1 2/2005 Brannon et al.
2005/0067351 A1 3/2005 Graham
2005/0091941 A1 5/2005 Baird
2005/0123385 A1 6/2005 Kirsch
2005/0201197 A1* 9/2005 Duell ..... B01F 3/1221 366/136
2006/0028914 A1 2/2006 Phillippi et al.
2006/0065400 A1 3/2006 Smith
2006/0107998 A1 5/2006 Kholy et al.
2006/0289166 A1 12/2006 Stromquist et al.
2007/0014653 A1 1/2007 Glenn et al.
2007/0114035 A1 5/2007 Parris et al.
2007/0179326 A1 8/2007 Baker
2007/0201305 A1 8/2007 Heilman et al.
2008/0008562 A1 1/2008 Beckel et al.
2008/0066911 A1 3/2008 Luharuka et al.
2008/0073895 A1 3/2008 Herman et al.
2008/0179054 A1 7/2008 McGough et al.
2008/0264641 A1 10/2008 Slabaugh et al.
2009/0078410 A1 3/2009 Krenek et al.
2009/0078792 A1* 3/2009 Vlasak ..... B01F 3/04503 239/403
2009/0090504 A1 4/2009 Weightman et al.
2010/0038077 A1 2/2010 Heilman et al.
2010/0071284 A1 3/2010 Hagan et al.
2010/0188926 A1* 7/2010 Stegemoeller ..... B01F 3/1221 366/137
2010/0243251 A1 9/2010 Luharuka et al.
2010/0243252 A1 9/2010 Luharuka et al.
2010/0243255 A1 9/2010 Luharuka et al.
2010/0278621 A1 11/2010 Redekop
2010/0319921 A1 12/2010 Eia et al.
2010/0329072 A1 12/2010 Hagan et al.
2011/0003720 A1 1/2011 Sullivan
2011/0026358 A1* 2/2011 Cheio De Oliveira . B01F 35/71 366/139
2011/0061855 A1 3/2011 Case et al.
2011/0063942 A1 3/2011 Hagan et al.
2011/0127178 A1 6/2011 Claussen
2011/0197536 A1 8/2011 Clark
2012/0024738 A1 2/2012 Herman et al.
2012/0048537 A1 3/2012 Rettie et al.
2012/0127820 A1 5/2012 Noles, Jr.
2012/0127822 A1 5/2012 Noles, Jr.
2012/0128449 A1 5/2012 Fikes et al.
2012/0134772 A1 5/2012 Herman et al.
2012/0167485 A1 7/2012 Trevithick et al.
2012/0219291 A1 8/2012 Chiku et al.
2012/0219391 A1 8/2012 Teichrob et al.
2012/0255734 A1 10/2012 Coli et al.
2012/0273206 A1 11/2012 Zamora et al.
2012/0298210 A1 11/2012 Pham et al.
2013/0105166 A1 5/2013 Medvedev et al.
2013/0150268 A1 6/2013 Oldham
2013/0269735 A1 10/2013 Roetzel et al.
2013/0288934 A1 10/2013 Powell et al.
2013/0309052 A1 11/2013 Luharuka et al.
2013/0324444 A1 12/2013 Lesko et al.
2014/0041317 A1 2/2014 Pham et al.
2014/0041319 A1 2/2014 Pham et al.
2014/0041322 A1 2/2014 Pham et al.
2014/0044508 A1 2/2014 Luharuka et al.
2014/0166647 A1 6/2014 Sheesley et al.
2014/0255265 A1 9/2014 Kulkarni et al.
2014/0364346 A1 12/2014 Weinstein et al.
2015/0044003 A1 2/2015 Pham
2015/0044004 A1 2/2015 Pham et al.
2015/0064077 A1 3/2015 McSpadden et al.
2015/0166260 A1 6/2015 Pham et al.
2015/0238912 A1 8/2015 Luharuka et al.
2015/0238914 A1 8/2015 Luharuka et al.
2015/0240148 A1 8/2015 Luharuka et al.
2016/0129418 A1 5/2016 Pham et al.
2016/0130924 A1 5/2016 Pham et al.
2017/0327309 A1 11/2017 Hunter et al.

FOREIGN PATENT DOCUMENTS

CN 2693601 Y 4/2005
CN 101434836 A 5/2009
CN 201317413 Y 9/2009
CN 201458370 U 5/2010
CN 201610285 U 10/2010
CN 202398329 U 8/2012
CN 202506322 U 10/2012
CN 203486442 U 3/2014
CN 103721619 A 4/2014
CN 204109871 U 1/2015
EP 0048312 A1 3/1982
EP 0241056 A1 10/1987
EP 2609999 A1 7/2013
FR 2655007 A1 5/1991
JP S5715828 A 1/1982
KR 100589613 B1 6/2006
RU 10418 U1 7/1999
RU 2228842 C2 1/2004
SU 1341161 A1 9/1987
WO 8500046 A1 1/1985
WO 1985000046 1/1985
WO WO 0244517 A1 * 6/2002 ..... B01F 3/1271
WO 03087182 A2 10/2003
WO 2007022300 A2 2/2007
WO 2007098606 A1 9/2007
WO 2010070599 A1 6/2010
WO 2011061503 A1 5/2011
WO 2011088493 A1 7/2011
WO 2012121896 A2 9/2012
WO 2012166590 A1 12/2012
WO 2013099826 A1 7/2013
WO 2013134624 A1 9/2013
WO 2014028317 A1 2/2014

OTHER PUBLICATIONS

Extended Search Report issued in European Patent Appl. No. 15755550.9 dated Oct. 9, 2017; 8 pages.
Office Action issued in Eurasian Patent Appl. No. 201691737/31 dated Mar. 19, 2018; 4 pages (with English translation).
Natural gas flow measurement, written and compiled by Long Yangming, Petroleum Industry Press, pp. 84-85, Mar. 1962.
Fracturing technology for ultra-low permeability reservoirs, written by Ran Xinquan, Petroleum Industry Press, pp. 223-224, Feb. 2012.

(56) References Cited

OTHER PUBLICATIONS

Office Action issued in Chinese Patent Appl. No. 201580032114.7 dated Jul. 18, 2018; 15 pages.
Practical Technical Manual for Dairy Product Engineer, edit by Gu Ming, pp. 605-607, China Light Industry Press, Jan. 2009.
Office Action issued in Chinese Patent Appl. No. 2015800109793 dated Sep. 12, 2018; 32 pages (with English translation).
Office Action issued in Chinese Patent Appl. No. 201580036796.9 dated Oct. 25, 2018; 29 pages (with English translation).
Office Action issued in Russian Patent Appl. No. 2015117758 dated Dec. 5, 2018; 13 pages (with English translation).
Office Action issued in Russian Patent Appl. No. 2015117770 dated Nov. 16, 2018; 16 pages (with English Translation).
Office Action issued in Russian Patent Application No. 2017102359 dated Mar. 7, 2018; 11 pages (with English translation).
Office Action issued in Russian Patent Application No. 2014132435 dated Apr. 3, 2018; 9 pages (with English translation).
Decision on Grant issued in Russian Patent Appl. No. 2017102359 dated Jul. 27, 2018; 16 pages (with English translation).
Office Action issued in Chinese Patent Appl. No. 201580034894.9 dated Jul. 3, 2018; 9 pages (with English translation).
Decision on Grant issued in Russian Patent Appl. No. 2014132435 dated Sep. 20, 2018; 24 pages (with English translation).
International Search Report and Written Opinion issued in PCT/US2015/059182 dated Feb. 29, 2016; 11 pages.
International Search Report and Written Opinion issued in PCT/US2015/059177 dated Feb. 17, 2016; 12 pages.
International Search Report and Written Opinion issued in PCT/US2015/030287 dated Jul. 29, 2015; 14 pages.
Examination Report dated Dec. 19, 2018 in corresponding AU Application No. 2015259393; 4 pages.
1st Examination Report dated Mar. 26, 2019 in corresponding SA Application No. 516380637 with agent's reporting letter; 7 pages.
Decision on Grant issued in Russian Patent Appl. No. 2015117770/05 dated Feb. 20, 2019; 20 pages (with English translation).
"Practical Technical Manuel for Dairy Product Engineer", Gu Ming editor, China Light Industry Press, Jan. 2009, pp. 605-607.
Office Action issued in Canadian Patent Application No. 2948002 dated May 31, 2021, 3 pages.
Office Action issued in U.S. Appl. No. 16/859,188 dated Sep. 27, 2021, 54 pages.
Exam Report issued in Australian Patent Application No. 2019283869 dated Oct. 15, 2021, 2 pages.
Examiner's Report issued in Canadian Patent Application No. 2858452 dated Oct. 25, 2021, 4 pages.
Office Action 97624 issued in Mexican Patent Application No. MX/a/2016/014601 dated Oct. 22, 2021, 7 pages.
Substantive Examination issued in Bahrain Patent Application No. 20160114 dated Jan. 10, 2022, 10 pages with English translation.
Office Action issued in U.S. Appl. No. 16/859,188 dated Jan. 18, 2022, 12 pages.
Examination Report dated Feb. 28, 2022 in corresponding Saudi Arabia Application No. 516380275; 7 pages (with English translation).
Re-examination report issued in Chinese Patent Application No. 201580036796.9 dated Mar. 30, 2022; 18 pages.
2nd Substantive Examination issued in Mexican Patent Application No. Mx/a/2016/014690 dated Nov. 23, 2022, 14 pages with English translation.
Substantive Examination issued in Bahrain Patent Application No. 20160114 dated Apr. 25, 2022, 9 pages with English translation.
Office Action issued in U.S. Appl. No. 16/859,188 dated May 3, 2022, 16 pages.
First Substantive Examination issued in Mexican Patent Application MX/a/2016/014690 dated Mar. 17, 2022, 16 pages with English translation.
Re-examination report issued in Chinese Patent Application No. 201580036796.9 dated Jul. 7, 2022; 40 pages with English translation.

* cited by examiner

MIXING APPARATUS WITH FLUSH LINE AND METHOD

BACKGROUND

Mixers (sometimes alternatively referred to as "blenders") are generally employed to disperse powdered chemicals into fluids. One application for mixers is in wellbore operations, for example, in preparing hydraulic fracturing fluid for injection into a subterranean formation. Generally, the fracturing fluid includes gelling agents, powders and other granular material, e.g., guar gum, which are initially dispersed into the fluid via the mixer, and subsequently hydrated, e.g., in tanks, to result in the desired viscosity for the fluid.

Certain powder and granular material mixers include a centrifugal pump and eductor, or a centrifugal or high or low shear blender for dispersing the powder and granular material into fluid (e.g., water). Generally, the fluid is pumped by the pump into a mixing chamber. In eductor mixers, the mixing chamber may be proximal to a throat of a converging-diverging nozzle such that the eductor draws the powder into the mixing chamber by the Venturi effect. In blender mixers, the blender is located in the mixing chamber, and the powders and grains are fed thereto, e.g., by gravity. In either case, the materials, e.g., in the form of dry powder, are introduced to the mixing chamber, and are dispersed into the fluid. Various devices are employed to avoid air entrainment during the dispersion process, or entrained air may be removed downstream, e.g., using a hydro-cyclone or another type of air separator. The fluid mixture may then be sent to equipment downstream for further hydration.

One challenge in dispersing powder additives such as gelling agents is that the powders may tend to agglomerate into clumps, sometimes referred to as "fisheyes." The powders may have cohesive properties, such that partially-hydrated balls form, e.g., with dry powder surrounded by a "skin" of partially-hydrated powder. This skin prevents hydration of the dry powder within, resulting in a stable fisheye in the fluid, rather than an even dispersion of the powder. As such, suboptimal mixing may result, which can affect downstream application. Moreover, there is an additional risk of buildup and/or clogging of the material, e.g., in the various throats of the system, if the materials are not sufficiently wetted at the point of introduction into the mixer.

Accordingly, in some instances, a pre-wetter may be employed to mitigate the risk of such clumping. Pre-wetters generally provide a fluid to the powder feed, upstream of the mixing. However, pre-wetters require a separate pump to deliver the fluid to the powder, upstream of the mixing chamber. Thus, additional pumping equipment (i.e., centrifugal pumps to provide fluid to pre-wetter) may complicate the overall system, adding costs, maintenance, and failure points. Moreover, the different pieces of equipment may limit the range of flowrates achievable for the system, limiting the applications for which a single size or configuration of mixer is suitable.

SUMMARY

Embodiments of the disclosure may provide a mixer that includes an impeller, a slinger, and a flush line. The impeller and slinger may be disposed in a back-to-back arrangement as part of an impeller/slinger assembly, and may be rotated via a connection with a shaft. The impeller draws fluid into the mixing chamber via a fluid inlet, pressurizes the fluid, and expels the fluid downward and outward. The fluid is then turned toward the slinger. The slinger may, through an additive inlet, receive additives that are to be mixed into the fluid, and may propel the additives radially outward, so as to mix the additives with the fluid.

The flush line may include an opening in the mixing chamber at a relatively high-pressure region of the mixing chamber, for example, near the impeller. The relatively high-pressure region may also be an area of relatively clean fluid (e.g., low concentration of additives) that may be tapped by the flush line. The flush line may extend to an additive-channeling structure (e.g., a cone or other type of hopper) through which the additives are received into the additive inlet. Using the pressure of the fluid in the mixing chamber, as provided by the impeller, the flush line may channel the relatively clean fluid from the mixing chamber to the additive-channeling structure, so as to pre-wet the additive, thereby reducing the potential for clumping.

While the foregoing summary introduces one or more aspects of the disclosure, these and other aspects will be understood in greater detail with reference to the following drawings and detailed description. Accordingly, this summary is not intended to be limiting on the disclosure.

BRIEF DESCRIPTION OF THE DRAWINGS

The accompanying drawings, which are incorporated in and constitute a part of this specification, illustrate an embodiment of the present teachings and together with the description, serve to explain the principles of the present teachings. In the figures.

Figure 1:
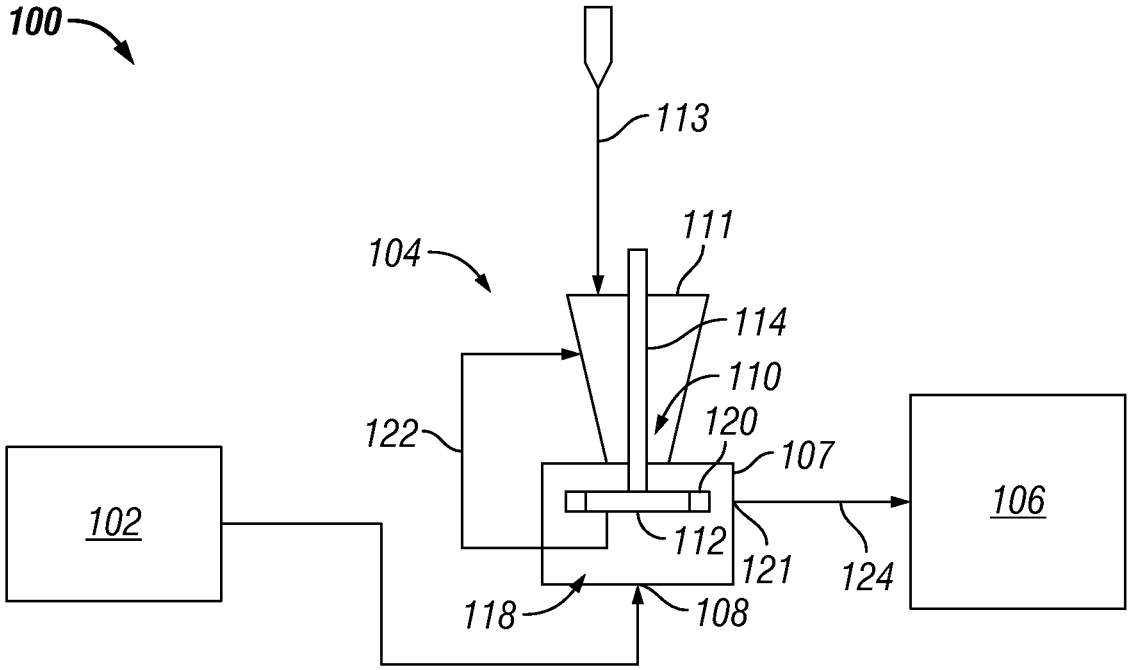
FIG. 1 illustrates a schematic view of a mixing system, according to an embodiment.

It should be noted that some details of the figures have been simplified and are drawn to facilitate understanding of the embodiments rather than to maintain strict structural accuracy, detail, and scale.

DETAILED DESCRIPTION

Reference will now be made in detail to embodiments of the present disclosure, examples of which are illustrated in the accompanying drawings. In the drawings and the following description, like reference numerals are used to designate like elements, where convenient. It will be appreciated that the following description is not intended to exhaustively show all examples, but is merely exemplary.

FIG. 1 illustrates a schematic view of a mixing system 100, according to an embodiment. The mixing system 100 may generally include a process fluid source 102, a mixer 104, and downstream equipment 106, among other potential components. The process fluid source 102 may be or include a tank of water, a water-based solution of a suitable pH and/or any other type of solution, or any substantially liquid substance. Further, the source 102 may include or be coupled with one or more pumps for delivery of the fluid to the mixer 104; however, in other embodiments, such pumps may be omitted with the mixer 104 providing the pumping, for example. The downstream equipment 106 may include any number of hydrating tanks, separators, other mixers/mixing systems, pumps, etc., so as to convert a slurry exiting the mixer 104 into a desired viscosity and/or composition fluid.

As schematically depicted, the mixer 104 may include a housing 107 as well as a fluid inlet 108 and an additive inlet 110 extending through the housing 107. The fluid inlet 108 may be coupled with the fluid source 102 and may be configured to receive fluid (i.e., the process fluid) therefrom. The additive inlet 110 may generally include an additive-receiving structure 111, which may be or include a cone, chamber, bowl, hopper, or the like, having an inner surface 115 configured to receive an additive 113, which may be a dry powder, and direct it into the housing 107, e.g. via gravity feed.

It will be appreciated that any dry, partially dry, crystalized, slurry, fluid, or pelletized, and/or packaged additive may be dispersed or otherwise mixed into the fluid using the mixer 104 via the additive inlet 110, as schematically depicted. Further, as will be described in greater detail below, additives received through the additive inlet 110 may be pre-wetted into a partial slurry, e.g., to avoid fisheyes and/or any material buildup. In particular, in various embodiments, the mixer 104 may be configured for use in mixing sand, guar, other powders, etc. with the fluid. Further, in some cases, the mixer 104 may be configured for use as a macerator, which may tear apart fibers, pouches containing powders, pellets, etc. for dispersion of its contents into the fluid. In at least one case, the mixer 104 may be configured for use in creating gel for use in fracturing operations, e.g., in a wellbore; however, the mixer 104 may be employed for any number of different uses, consistent with the present disclosure.

The mixer 104 may also include an impeller/slinger assembly 112, which may be driven by a shaft 114. The housing 107 may define a mixing chamber 118 therein that is in communication with the inlets 108, 110. The impeller/slinger assembly 112 may be disposed in the mixing chamber 118. Rotation of the impeller/slinger assembly 112 may pump the fluid from the source 102 through the mixing chamber 118 and into the outlet 121.

As shown, the shaft 114 may extend upwards, through the inlet 110 and out of the additive-receiving structure 111; however, this is but one example among many contemplated. In another example, the impeller/slinger assembly 112 may extend downward through the bottom of the housing 107, may be magnetically driven, driven internally within the mixing chamber 118, or may be otherwise disposed in the housing 107. The shaft 114 may be coupled with the impeller/slinger assembly 112, such that rotation of the shaft 114 rotates the impeller/slinger assembly 112. In various cases, the shaft 114 may be directly coupled to the impeller/slinger assembly 112, e.g. via a bolt; however, in other cases, gears, linkages, other speed-changing devices, or couplings may be employed to connect the shaft 114 to the impeller/slinger assembly 112.

The mixer 104 may also include a stator 120, which may be in the form of a ring, arcuate portion, etc., which may be disposed around the impeller/stator assembly 112, as will be described in greater detail below. Further, the mixer 104 may include an outlet 121 and a flush line 122. The outlet 121 may receive a slurry formed from a combination of the additive received through the additive inlet 110 and the fluid received through the fluid inlet 108. The outlet 121 may direct the slurry to one or more conduits 124, which may carry the fluid to the downstream equipment 106.

The flush line 122 may communicate with an area of the mixing chamber 118 that is proximal to the impeller/slinger assembly 112 on one end, and with the additive-receiving structure 111 on the other end. Accordingly, the flush line 122 may tap the process fluid from the mixing chamber 118 at an area of relatively high pressure and deliver it to the inner wall of the additive-receiving structure 111, which may be at a reduced (e.g., ambient) pressure. In addition to being at the relatively high pressure, the fluid tapped by the flush line 122 may be relatively "clean" (i.e., relatively low additives content, as will be described below), so as to pre-wet fluid to the additive-receiving structure 111 and promote the avoidance of clumping of the additives. In some cases, the flush line 122 may provide the pre-wetting fluid without requiring additional pumping devices (apart from the pumping provided by the impeller/slinger assembly 112) or additional sources of fluid or lines from the source 102. In other examples, booster pumps, etc., may be provided in addition to or in lieu of tapping the fluid from the mixing chamber 118.

Figure 2:
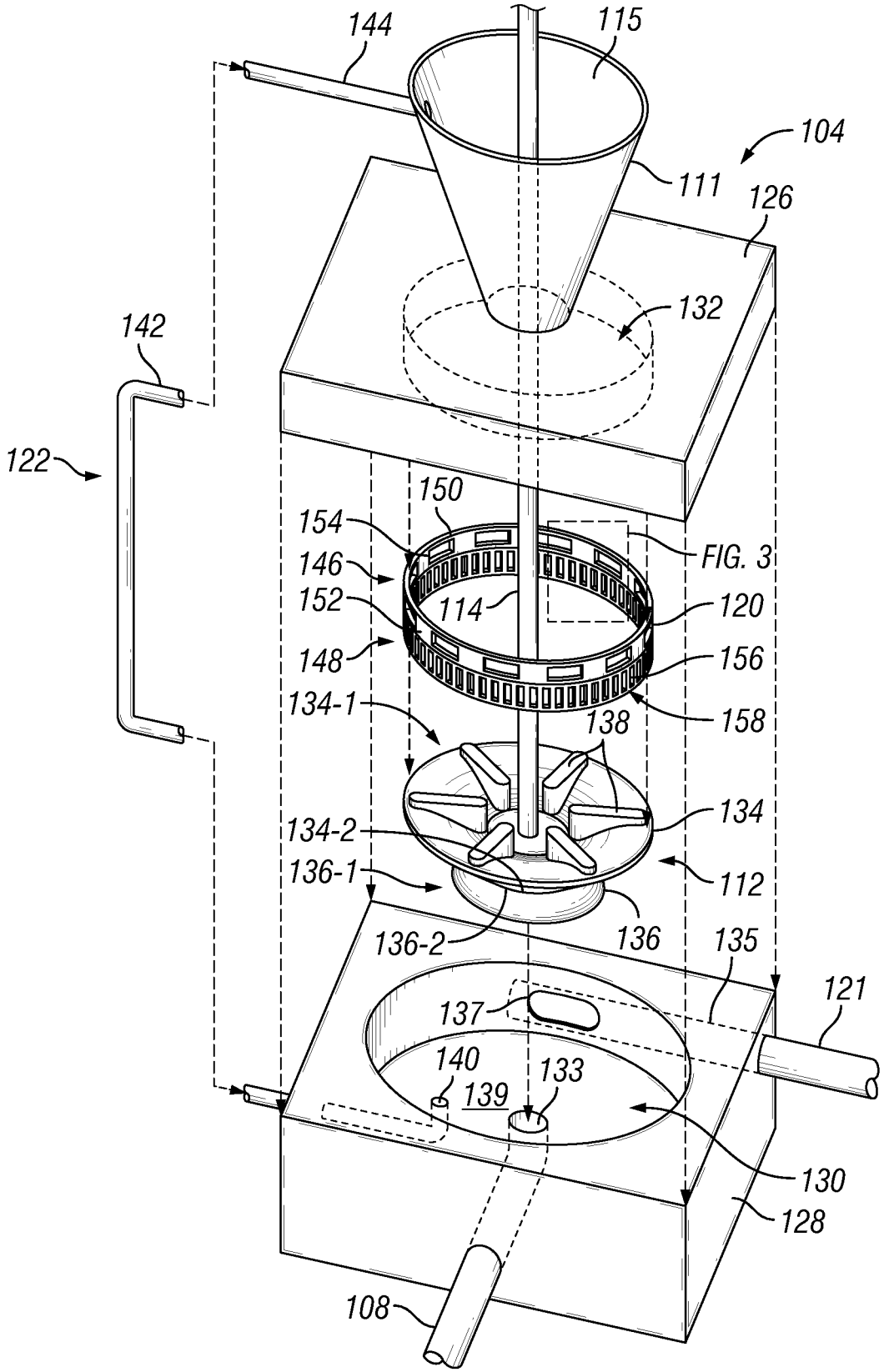
FIG. 2 illustrates an exploded, perspective view of the mixer, according to an embodiment.

FIG. 2 illustrates an exploded perspective view of the mixer 104, according to an embodiment. As noted above, the mixer 104 may include the housing 107, which is depicted in FIG. 2 as formed from two portions: a first or "upper" housing portion 126 and a second or "lower" housing portion 128. The upper and lower housing portions 126, 128 may be connected together, e.g., via bolts, clamps, other fasteners, adhesives, welds, etc., so as to define the mixing chamber 118 (FIG. 1) therebetween. In one specific example, the lower housing portion 128 may define a mixing area 130, and the upper housing portion 126 may define a mixing area 132 (shown in phantom), which may be generally aligned. The mixing areas 130, 132 may together define the mixing chamber 118 (FIG. 1), in which the impeller/slinger assembly 112 and the stator 120 may be disposed. The lower housing portion 128 may also include an interior surface 139, e.g., defining the bottom of the mixing area 130. It will be appreciated that a variety of configurations of the housing 107, including unitary and segmented embodiments, embodiments with doors, etc. are contemplated.

The upper housing portion 126 may be coupled with the additive-receiving structure 111 and may provide the additive inlet 110. The lower housing portion 128 may include the fluid inlet 108, which may extend through the lower housing portion 128 to a generally centrally-disposed opening 133. In an embodiment, the opening 133 may be defined in the interior surface 139. In addition, the outlet 121 may extend from the mixing area 130, for example, including a substantially tangential conduit 135 extending from an opening 137 communicating with the mixing area 130.

Turning to the impeller/slinger assembly 112 disposed in the mixing chamber 118, the impeller/slinger assembly 112 may include a slinger 134 and an impeller 136. The slinger 134 and the impeller 136 may have inlet faces 134-1, 136-1, respectively, and backs 134-2, 136-2, respectively. The inlet faces 134-1, 136-1 may be each be open (as shown) or at least partially covered by a shroud, which forms an inlet in the radial inner part of the slinger 134 and/or impeller 136. Moreover, the inlet faces 134-1, 136-1 may be oriented in opposite directions, e.g., to receive fluid and/or dry components. The backs 134-2, 136-2 may be disposed proximal to one another and, e.g., coupled together, such that, for example, the impeller 136 and the slinger 134 are disposed in a "back-to-back" configuration.

In an embodiment, the inlet face 134-1 of the slinger 134 may face the additive inlet 110 (e.g., the additive-receiving structure 111), while the inlet face 136-1 of the impeller 136 may face the fluid inlet 108 (e.g., the opening 133), as shown. For example, the inlet face 136-1 of the impeller 136 may face the interior surface 139, with the opening 133, defined on the interior surface 139, being aligned with a radial middle of the impeller 136.

Accordingly, as defined by the direction in which the inlet faces 134-1, 136-1 are oriented, the slinger 134 may face upwards, as shown, but in other embodiments may face downwards or in a lateral direction. Similarly, the impeller 136 may face downwards, as shown, but in other embodiments, may face upwards or in a lateral direction. Further, the slinger 134 and the impeller 136 may each have a radius, with the radius of the slinger 134 being larger than the radius of the impeller 136. The radii of the slinger 134 and impeller 136 may be dependent upon one another, so as to control a position of a fluid-air boundary, as will be described in greater detail below.

The slinger 134 may further define a saucer-shape, as shown, i.e., formed generally as a flatter (or flat) middle with arcuate sides and the inlet face 134-1. In an embodiment, the sides may be formed, for example, similar to, or as part of a torus that extends around the middle of the slinger 134. In another embodiment, the slinger 134 may be bowl-shaped (e.g., generally a portion of a sphere). Further, the slinger 134 may include slinger blades 138 on the inlet face 134-1. The number of blades 138 may range from about two blades to about 20 blades, for example, about nine blades. In some cases, the blades 138 may be curved circumferentially as proceeding radially outwards from the shaft 114, but in others the blades 138 may be straight, as shown. When rotated, the slinger 134 may be configured to propel fluid and/or dry additives received from the inlet 110 radially outwards by interaction with the blades 138 and upwards (as shown), e.g., as influenced by the shape of the slinger 134.

Although not visible in FIG. 2, the impeller 136 may also include a plurality of blades on the inlet face 136-1, which may be generally aligned with the opening 133. When the shaft 114 is turned, the impeller blades may draw fluid through the opening 133 of the fluid inlet 108, and then expel the fluid downwards and radially outwards. As such, a region of relative high pressure may develop between the lower housing portion 128 and the impeller 136, which may act to drive the fluid around the mixing chamber 118 and toward the slinger 134.

The flush line 122 may include an opening 140 defined in the lower housing portion 128 proximal to this region of high pressure. For example, the opening 140 may be defined in the interior surface 139 at a position between the outer radial extent of the impeller 136 and the opening 133 of the inlet 110. In other embodiments, the opening 140 may be disposed on the interior surface 139 and radially outside of the impeller 136 and/or elsewhere in the mixing chamber 118. The flush line 122 may also include a conduit 142, which may be or include one or more pipes, tubes, hoses, flow restrictors, check valves, etc. The conduit 142 may connect with a cone inlet 144 defined, for example, substantially tangent to the additive-receiving structure 111, such that fluid is transported from the opening 140 via the conduit 142, through the cone inlet 144, and into the additive-receiving structure 111. The fluid may then take a generally helical path along the interior of the additive-receiving structure 111, until it is received through the additive inlet 110 to the slinger 134. As such, the fluid received through the cone inlet 144 may generally form a wall of fluid along the inner surface 115 of the additive-receiving structure 111.

In at least one specific embodiment, a pressure gradient may develop between the impeller 136 and the lower housing portion 128, with the pressure in the fluid increasing as proceeding radially outwards from the opening 133. Another gradient, related to the concentration of the additives in the fluid may also develop in this region, with the concentration of additives increasing as proceeding radially outward. In some cases, a high pressure head and low concentration may be desired, so as to provide a flow of relatively clean fluid through the flush line 122, propelled by the impeller/slinger assembly 112. Accordingly, the opening 140 for the flush line 122 may be disposed at a point along this region that realizes an optimal tradeoff between pressure head of the fluid and concentration of the additives in the fluid received into the flush line 122. Additional details regarding the tradeoff are provided below.

Turning again to the stator 120, the stator 120 may form a shearing ring, which may be received around the radial outside of the impeller/slinger assembly 112 and in the mixing chamber 118 (FIG. 1). In an example, the stator 120 may be coupled with the upper housing portion 126, e.g., via bolts, other fasteners, adhesives, welding, etc.

Figure 3:
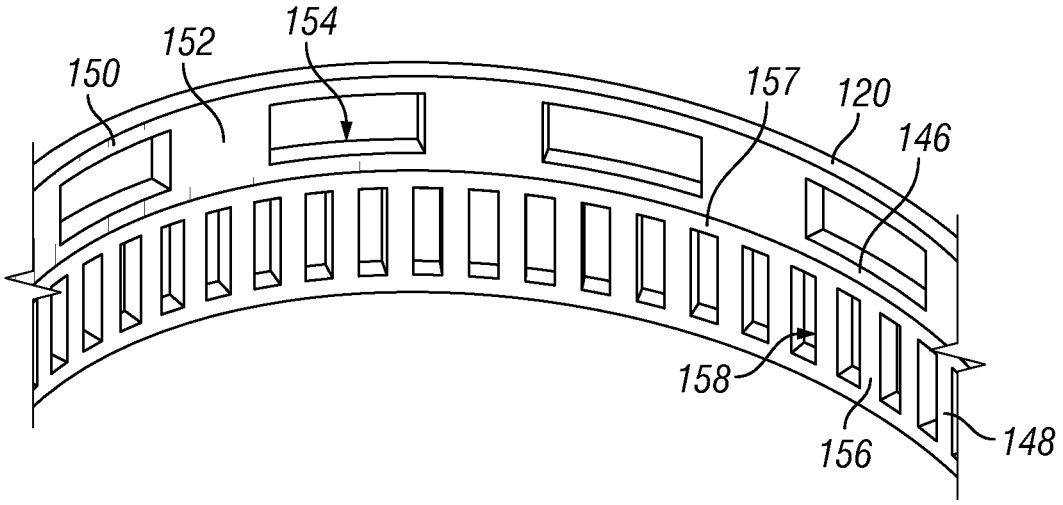
FIG. 3 illustrates an enlarged view of a portion of the stator of the mixer illustrated in FIG. 2, according to an embodiment.

FIG. 3 illustrates an enlarged sectional view of the stator 120 of FIG. 2, according to an embodiment. Referring now to both FIGS. 2 and 3, as shown, the stator 120 may include first and second annular portions 146, 148, which may be stacked together to form the stator 120. The stator 120 may be held generally stationary with respect to the rotatable impeller/slinger assembly 112, e.g., via fastening with the upper housing portion 126. In another embodiment, the stator 120 may be supported by the impeller/slinger assembly 112 and may rotate therewith. In either example, the stator 120 may ride on the inlet face 134-1 of the slinger 134, or may be separated therefrom.

The first annular portion 146 may be configured to minimize flow obstruction. As shown, in some cases, the first annular portion 146 may include a shroud 150 and posts 152 defining relatively wide slots 154, allowing relatively free flow of fluid therethrough. In other embodiments, the first annular portion 146 may omit the shroud 150, as will be described in greater detail below.

While the first annular portion 146 may minimize flow obstruction, the second annular portion 148 may be configured to maximize flow shear, so as to promote turbulent mixing, and thus may include a series of stator vanes 156 that are positioned closely together around the stator 120. Narrow flowpaths 158 may be defined between stator vanes 156; however, the sum of areas of the flowpaths 158 may be less than the sum of the areas of the stator vanes 156. In various embodiments, the ratio of the stator vane 156 cross-sectional area (i.e., the area that obstructs flow) to the area of the flowpaths 158 may be between about 1:2 and about 4:1, for example, about 1.5:1. Further, the area of each of the stator vanes 156 may be greater than the area of each of the flowpaths 158. Moreover, the stator vanes 156 may be disposed at any pitch angle with respect to the circumference of the stator 120. For example, the stator vanes 156 may be oriented straight radial, against rotation (e.g., to increase shear), or with rotation. In the example illustrated in FIG. 2 (and also in FIGS. 3 and 4, described below), the stator vanes 156 may have a shroud 157 that separates the sections 146, 148. In other embodiments, as will be described in greater detail below, the stator 120 may omit either or both of the shrouds 150, 157.

Figure 5:
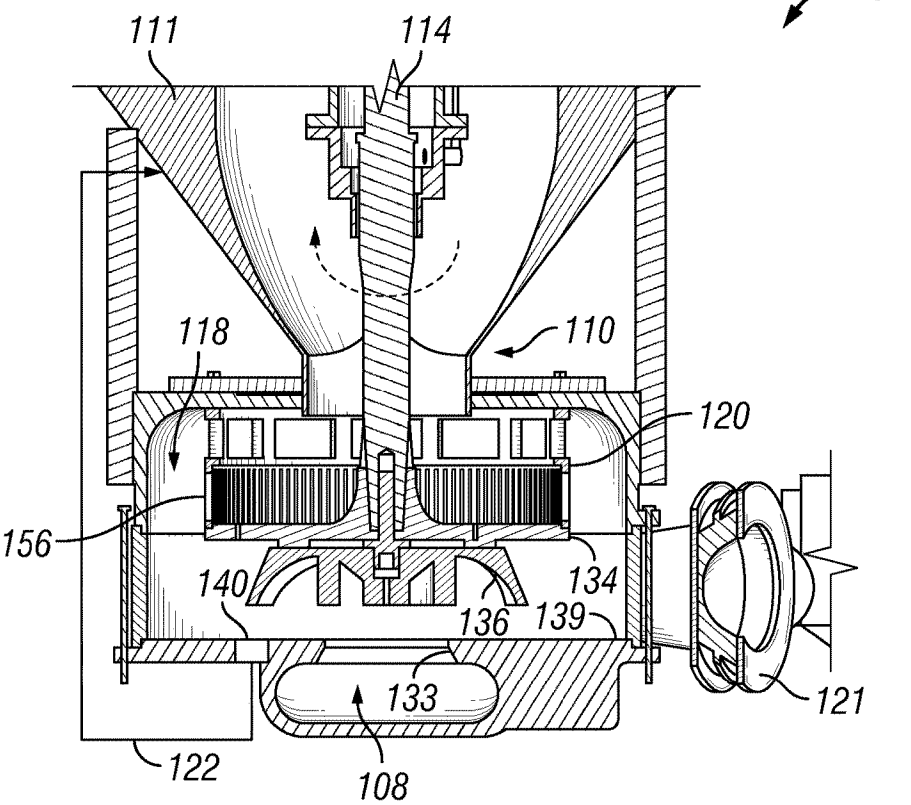
FIG. 5 illustrates a side, cross-sectional view of the mixer, according to an embodiment.
Figure 4:
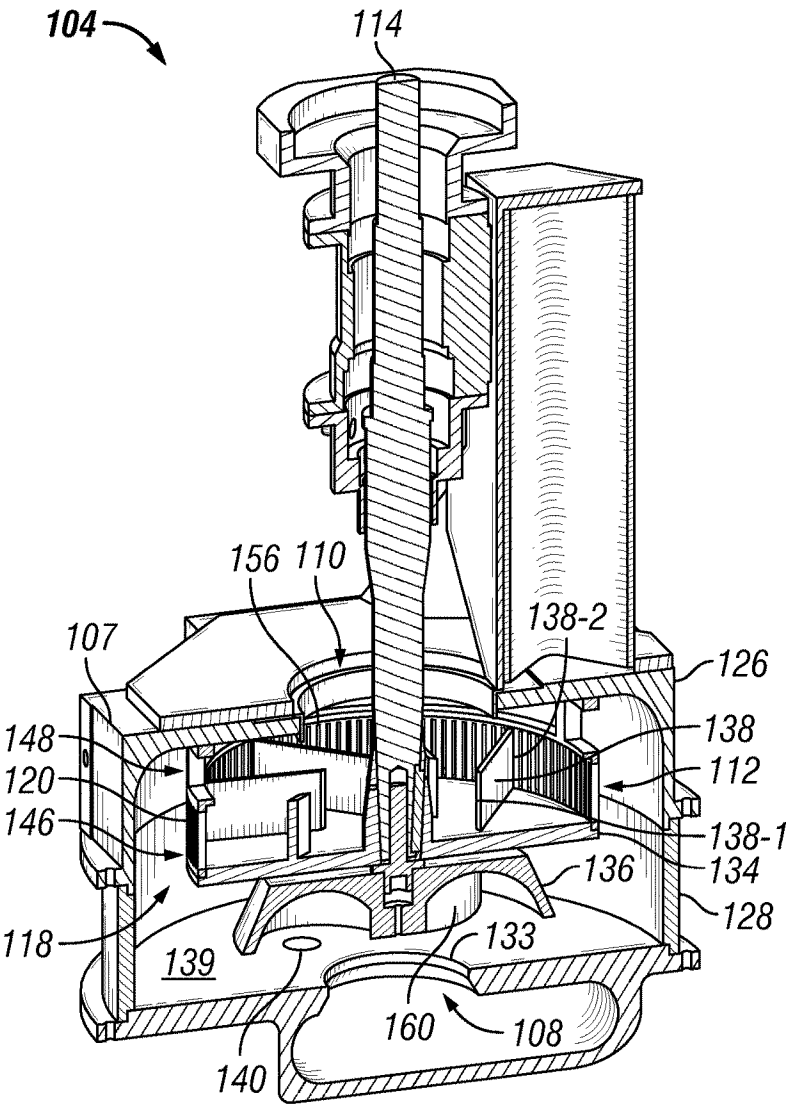
FIG. 4 illustrates a perspective view of a section of the mixer, according to an embodiment.

FIG. 4 illustrates a perspective view of a section of the mixer 104, according to an embodiment. FIG. 5 illustrates a side cross-sectional view of the mixer 104, with the flush line 122 illustrated schematically, according to an embodiment. Referring to both FIGS. 4 and 5, the shaft 114 extends through the additive inlet 110 and is coupled with the impeller/slinger assembly 112. The impeller 136 faces the opening 133, such that impeller blades 160 of the impeller 136 draw fluid through the inlet 108 via the opening 133.

Figure 6:
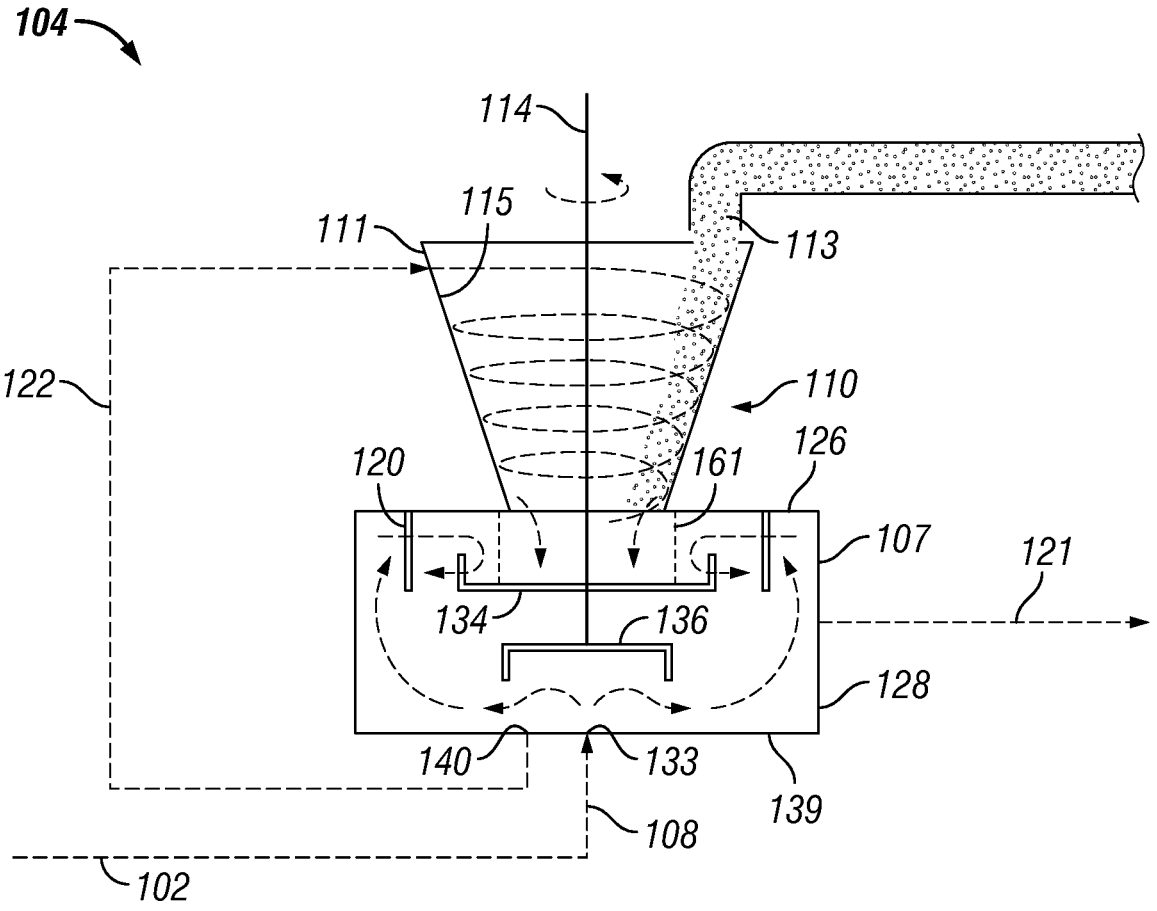
FIG. 6 illustrates a side schematic view of the mixer, according to an embodiment.

With continuing reference to FIGS. 4 and 5, FIG. 6 schematically illustrates a simplified view of the cross-section of the mixer 104, according to an embodiment. As shown, the impeller 136 may draw the fluid upward from the interior surface 139, and then expel it downwards (toward the interior surface 139) and radially outward. The fluid may then move upward in the mixing chamber 118, e.g., along an outer wall of the housing 107 to the top of the upper housing portion 126, where it may be turned radially inwards. The fluid may then proceed through the first annular portion 146 of the stator 120 to the slinger 134, and then be pushed radially outward, as well as upward, back toward the upper housing portion 126. This may create a turbulent churning, as well as a hydrodynamically-stable interface between the fluid and the air, generally manifesting as a ring-shaped air-fluid boundary or "eye" 161 (FIG. 6) between a root 138-1 and a tip 138-2 of the slinger blades 138. The slinger 134 thus tends to create a cyclonic separation effect, whereby air received through the inlet 110 is prevented from entrainment in the fluid received from the impeller 136.

Meanwhile, the additives 113 are poured into or otherwise received through the inlet 110, e.g., propelled by gravity, but may also be propelled by pressure differentials, vacuums, blowers, pumps, etc. The additives are then received onto the inlet face of the slinger 134, e.g., on the air side of the air-fluid boundary. The additives collide with the blades 138 and are slung radially outward into the fluid received from the impeller 136, while producing a circumferential velocity component to the fluid and dry additives. The circumferentially- and radially-driven dry additives and fluid then pass through the second annular portion 148 of the stator 120, where the combination is subjected to a high shear by interaction with the stator vanes 156 as it passes through the flowpaths 158. The shearing provided by the interaction with the blades 138 and stator vanes 156 and the turbulent flow developed by the impeller/slinger assembly 112 may provide a generally uniform dispersion of the additives in the fluid from the source 102, resulting in a slurry.

In particular, the first section 146 of the stator 120 is disposed at a small radial clearance from the slinger blades 138 (e.g., radially outward therefrom) such that the slurry mixture of additives 113 (e.g., powdered chemicals) and fluid being slung outward by the slinger blades 136 is sheared in a first stage in the clearance, by the relative movement of the blades 134 and the stator vanes 156. The slurry is then subjected to a second shear stage, as it is squeezed between the adjacent stator vanes 156 and pushed radially outwards through the flowpaths 158 by the action of the slinger 134. Moreover, the sudden expansion of the flow area radially outside of the stator 120 results in cavitation, further promoting mixing. As such, the mixer 104 provides, in operation, a two-stage, high shearing and regional cavitation mixing. The second section 148 of the stator 120 may have a substantially larger opening and be disposed above the slinger blades such that it allows the fluids to enter the slinger 134 through the slots 154, or otherwise minimizes flow obstruction through the stator 120.

The slurry may undergo such mixing multiple times, churning back through portions of the slinger 134 to effect further dispersion of the additives into the fluid, and eventually reaches the outlet 121, as shown in FIG. 5. The slurry reaching the outlet 121 is channeled from the mixing chamber 118, e.g., to downstream equipment 106 (FIG. 1) for further hydration, deployment, treatment, etc. Further, as schematically depicted in FIG. 5, the mixer 104 may also provide a self-regulating pre-wetter with the flush line 122. The opening 140 may be disposed in the interior surface 139 of the lower housing portion 128, e.g., radially inside or outside of the outer radial extent of the impeller 136. This may represent an area of high pressure in the mixing chamber 118, which is "clean" relative to fluid in other parts of the mixing chamber 118, e.g., proximal to the outlet 121 and/or in the slinger 134.

The tapped, relatively clean fluid received via the opening 140 may flow through the flush line 122 to the additive-receiving structure 111. The pre-wetting fluid may then flow, e.g., by gravity, along the interior surface of the additive-receiving structure 111 through the inlet 110 and back to the slinger 134. As such, the additives may be urged along the additive-receiving structure 111, toward the slinger 134, while being pre-wetted therein. This may serve to minimize clumping along the surface of the additive-receiving structure 111.

Figure 7:
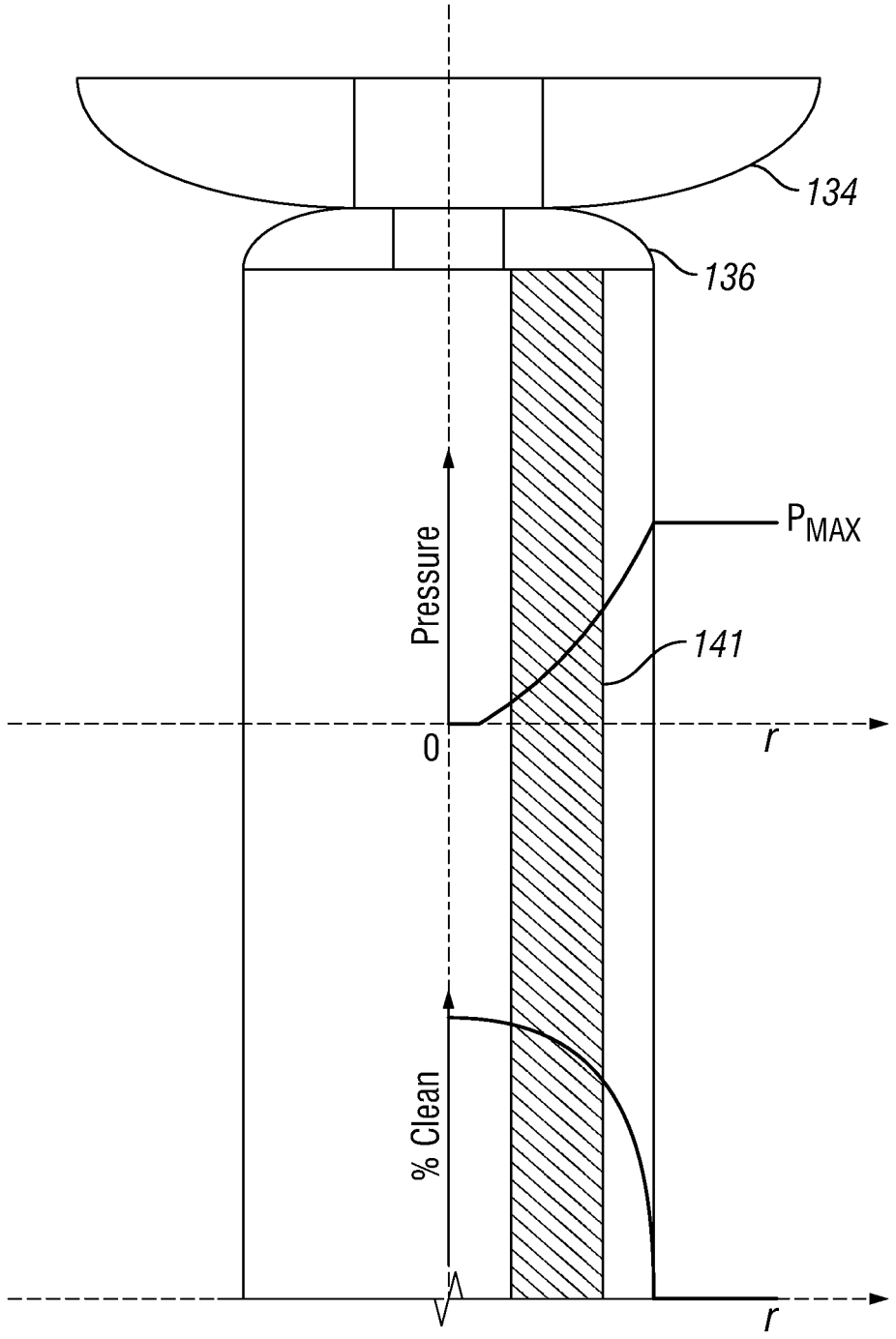
FIG. 7 illustrates a plot of pressure and cleanliness of the fluid versus radius, according to an embodiment.

FIG. 7 illustrates a plot of pressure and cleanliness in the fluid in the mixing chamber 118 versus the radius from the center of the opening 133, which is aligned with the center of the impeller 136. As shown, proceeding radially outward with respect to the impeller 136, the pressure may move from ambient (i.e., zero psig) to a maximum pumping pressure provided by the impeller 136. The relationship between radial position and pressure head may be generally exponential, until the position reaches the radial extent of the impeller 136.

Conversely, the "cleanliness," that is, the inverse of the concentration of additives in the fluid, or, stated otherwise, the purity of the fluid, may decrease proceeding radially outward, as the fluid received through the inlet 108 is mixed with the additives. Accordingly, a tapping region 141 may be calculated, providing the optimal tradeoff between pressure head and cleanliness in the fluid tapped by the flush line 122 via the opening 140.

Moreover, the flowrate of the relatively clean fluid through the flush line 122 may be controlled, for example, by matching a location or size of the opening 140, the conduit 142, and/or the cone inlet 144 to the pressure head developed by the impeller 136. With a known pressure drop through the flush line 122, such control may result in an optimized amount of fluid flowing through the flush line 122. Further, the flush line 122 may include one or more flow control devices, which may further allow for adjustment of the flowrate through the flush line 122.

Figure 8:
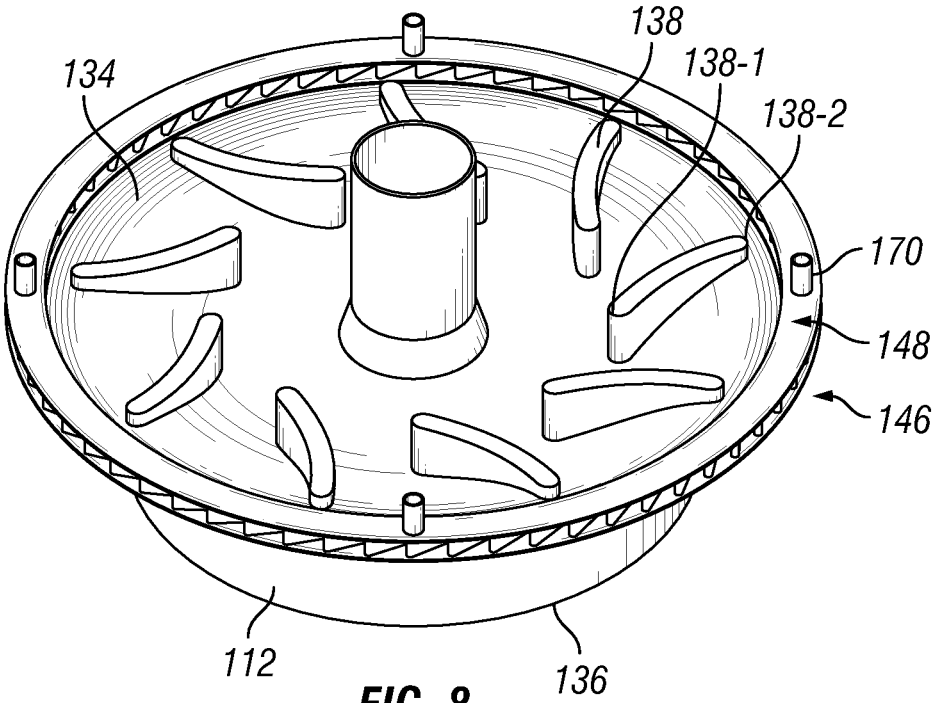
FIG. 8 illustrates a perspective view of an impeller/slinger assembly of the mixer, according to an embodiment.

FIG. 8 illustrates a perspective view of the impeller/slinger assembly 112 and the stator 120, according to an embodiment. The stator 120 may include the first and second annular portions 146, 148, as described above. However, the second annular portion 148 may include a plurality of posts 170, which may extend upwards from the first annular portion 146, but may not include a shroud. For example, the posts 170 may be coupled to the upper housing portion 126 (FIG. 2). The posts 170 may be any shape, including cylindrical, aerofoils, etc. and may be spaced apart so as to define wide channels therebetween. Accordingly, the second annular portion 148 may be configured to minimize flow obstruction therethrough.

Moreover, as shown, the stator vanes 156 may be pitched at an angle relative to the circumference of the stator 120, for example, opposite to rotation, so as to maximize shearing. Similarly, the slinger blades 138 may be curved circumferentially, e.g., to facilitate slinging the fluid and additives radially outwardly, and with a circumferential velocity component, so as to produce the shearing.

The stator 120 illustrated in FIG. 8 may act as a diffuser. In at least one embodiment, the stator vanes 156, as illustrated, may be oriented to recover pressure and/or may facilitate air introduction into the slurry, for example, in foaming operations.

Figure 9:
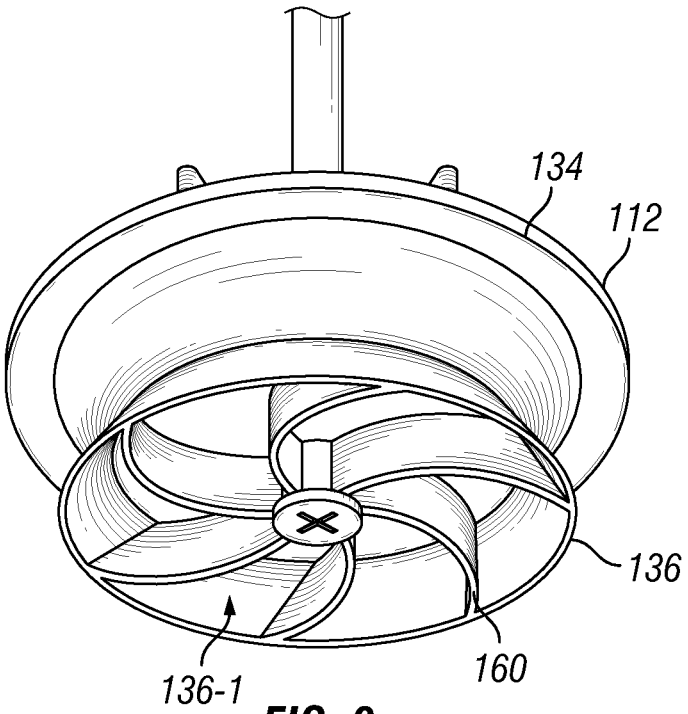
FIG. 9 illustrates another perspective view of the impeller/slinger assembly, according to an embodiment.

FIG. 9 illustrates another perspective view of the impeller/slinger assembly 112, illustrating the inlet face 136-1 of the impeller 136, according to an embodiment. As shown, the blades 160 of the impeller 136, which may be curved, straight, or any other suitable geometry, may draw fluid upwards, and then expel it radially outwards into the mixing chamber 118 (e.g., FIG. 3). It will be appreciated that the impeller 136 may be configured for high-speed (e.g., between about 300 rpm and about 20,000 rpm) use, and may be capable of pumping of producing between about 5 psi (about 34 kPa) and about 150 psi (about 1000 kPa), e.g., about 60 psi (about 414 kPa) of head.

Figure 10:
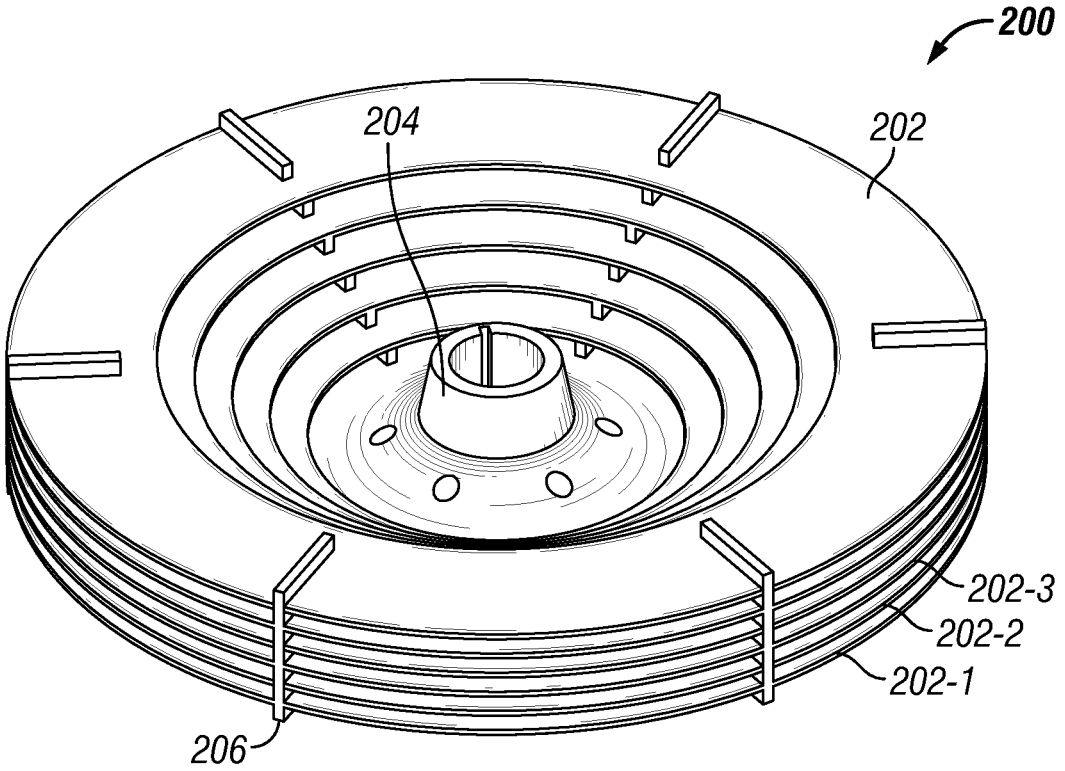
FIG. 10 illustrates a perspective view of a slinger of the mixer, according to an embodiment.

FIG. 10 illustrates a perspective view of another slinger 200 of the mixer 104, according to an embodiment. In some cases, rotor blades (such as blades 138 as shown in FIG. 1) may achieve dispersion that exceeds desired rates, e.g., with engineered particles such as encapsulated breakers. This may cause, in some cases, premature release of chemicals in the fluid. Accordingly, in an embodiment, the slinger 200 may provide a low shear or controlled shear dispersion that can handle such delicate chemicals, which are prone to damage or otherwise unsuitable for use in the more-aggressive slinger embodiments. In particular, the slinger 200 may effect a relatively gradual dispersion using generally concentric, annular disks 202, which are stacked one on top of the other upward from a hub 204. The annular disk 202-1 closest to the hub 204 may have a smaller inner diameter than the annular disk 202-2 adjacent thereto, which in turn may have a smaller inner diameter than the annular disk 202-3. This may repeat as proceeding between adjacent disks 202 away from the hub 204, so as to provide an inlet face 205 for the slinger 200 through which fluid and/or additives may be received and propelled outwards. It will be appreciated that any number of annular disks 202 may be included.

In an embodiment, the disks 202 may be held apart by vanes 206, providing narrow flowpaths between the disks 202. The vanes 206 may provide slots, one for each of the annular disks 202, into which the annular disks 202 may be received and coupled to the vanes 206. Accordingly, the narrow paths may extend radially outwards, for example, obstructed in the radial direction only by the narrow vanes 206. In other embodiments, separate vanes may extend between each pair of adjacent disks 202, rather than or in addition to the vanes 206 that extend through the entire set of disks 202. Moreover, in some embodiments, the vanes 206 may couple with one or more subsets of the total number of disks 202. In some cases, the vanes 206 may be omitted, with the disks 202 held together in a spaced-apart relation in any other suitable manner.

The large surface area of the annular disks 202 bordering the flowpaths, and the narrowness of the flowpaths, may result in shearing and turbulent flow of the fluid therethrough. Such shearing may have a similar effect as the slinger 134 and stator 120 discussed above, and may promote dispersion of dry additives into fluid being slung radially outwards therethrough, while minimizing the impact forces from the vanes 204 which may damage more delicate material. In some cases, the shearing provided by the slinger 200 may result in the stator 120 being omitted; however, in other cases, the shearing effects of the stator 120 and the slinger 200 may be combined.

Figure 11:
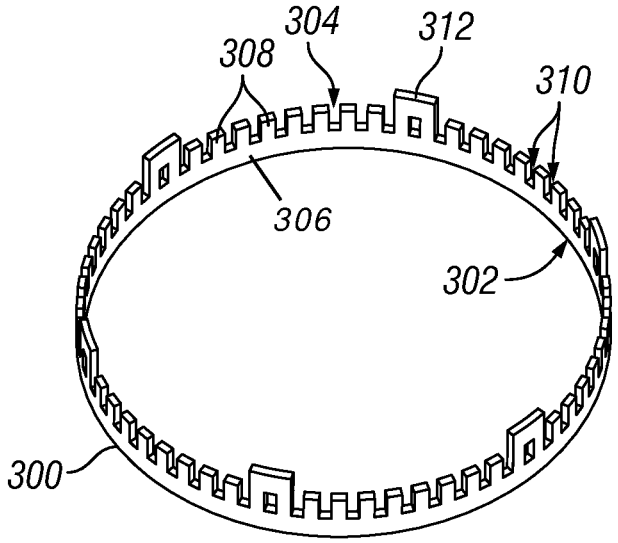
FIG. 11 illustrates a perspective view of a stator of the mixer, according to an embodiment.

FIG. 11 illustrates a perspective view of a shroudless stator 300, according to an embodiment. As shown, the stator 300 includes first and second annular portions 302, 304, which may, as shown, both be shroudless. The first annular portion 302 may include a base 306 and a series of vanes 308 extending upwards from the base 306 and disposed at intervals around the first annular portion 302. Flowpaths 310 are defined between adjacent vanes 308.

With the stator 300 being shroudless, the top of the flowpaths 310 may be open-ended, opening into the second annular portion 304 of the stator 120. The second annular portion 304 may include tabs 312 extending upwards from the first annular portion 302. The tabs 312 may be thicker, circumferentially, than the vanes 308, for example, each spanning two vanes 308 and one of the flowpaths 310; however, any relative sizing of the vanes 308 and tabs 312 may be employed. The shroudless configuration may minimize obstruction of the flow from the impeller 136, increasing efficiency of the mixer 104.

Figure 12:
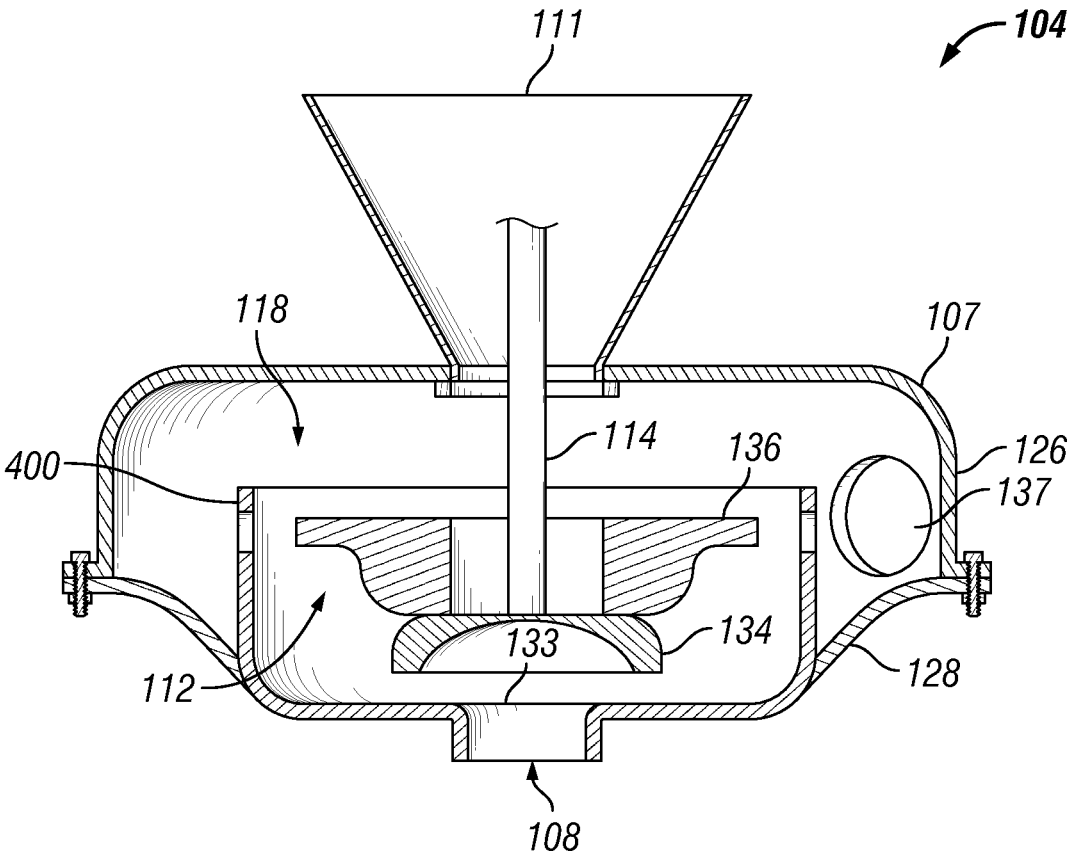
FIG. 12 illustrates a side, cross-sectional view of another embodiment of the mixer.

FIG. 12 illustrates a side, cross-sectional view of the mixer 104, according to another embodiment. The embodiment shown in FIG. 12 may be generally similar to the embodiment of the mixer 104 shown in one or more of FIGS. 1-8, with similar components being referred to using like numerals and duplicative description being omitted herein. The mixer 104 shown in FIG. 12 may, however, have a stator 400 that is integrated with the housing 107, for example, with the lower housing portion 128. Accordingly, the stator 400 may be spaced radially apart from and may circumscribe the impeller/slinger assembly 112, with the outlet 121 being disposed radially outward of the stator 400. Supporting (and/or integrating) the stator 400 by the lower housing portion 128 may facilitate low friction rotation of the impeller/slinger assembly 112, since the stator 400 and the impeller/slinger assembly 112 may not be in contact with one another. In another embodiment, the stator 400 may be suspended from and/or integrated with the upper housing portion 126 to similar effect.

This embodiment of the mixer 104 may, in some cases, ensure all or substantially all of the incoming fluid is mixed with the additive chemical before exiting the mixer 104. For example, in cement mixing, the mixer 104 may blend the powder uniformly, so as to avoid relying on the pipe turbulence downstream of the mixer 104 to effect such mixing.

As with the stator 120, the stator 400 may be shrouded or shroudless, and may include two or more annular portions (e.g., one for low flow disruption and one for high flow disruption). The stator 400 may, however, be configured to receive substantially all fluid flow out of the volume of fluid, which may enhance bulk mixing. Such a mixer 104 embodiment employing the stator 400 may be suited for powder dispersion into a very viscous fluid medium as well as when powder volume fraction in the mixture is high, e.g., with cement mixing. Additionally, although not shown, embodiments of the mixer 104 shown in FIG. 12 may include a flush line 122, e.g., as described above.

Figure 13:
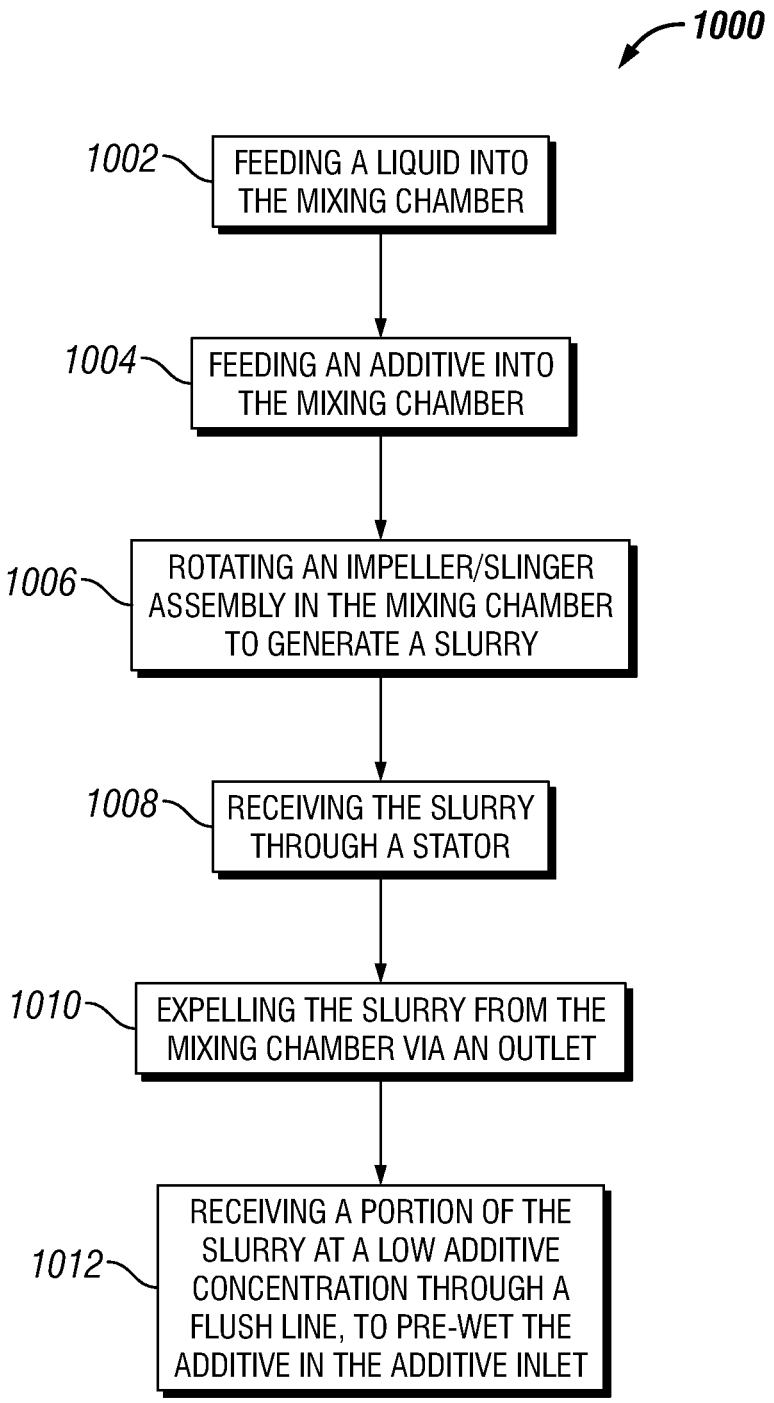
FIG. 13 illustrates a flowchart of a method for dispersing an additive in a fluid, according to an embodiment.

FIG. 13 illustrates a flowchart of a method 1000 for dispersing an additive, such as a dry additive (e.g., powder, granules, etc.) into a fluid, according to an embodiment. The method 1000 may proceed by operation of one or more embodiments of the mixing system 100 and/or the mixer 104 and, thus, is described herein with reference thereto. However, it will be appreciated that the method 1000 is not limited to any particular structure, unless otherwise expressly stated herein.

The method 1000 may include feeding a fluid into the mixing chamber 118 of the mixer 104 through the fluid inlet 108, as at 1002. For example, the mixing chamber 118 may be defined within the housing 107, which may define the fluid inlet 108 that receives the fluid from the source 102. The method 1000 may also include feeding the additive into the mixing chamber 118 through the additive inlet 110, as at 1004. The feeding at 1004 may be propelled by gravity, for example, by pouring the additive into the additive-receiving structure 111 of the additive inlet 110, although other methods for feeding the additive are also contemplated.

The method 1000 may also include rotating the impeller/slinger assembly 112 disposed in the mixing chamber 118, as at 1006. Rotating the impeller/slinger assembly 112 may draw fluid from the fluid inlet 108 (e.g., upwards) and radially outward, for example, by action of the impeller 136 disposed with its inlet face 136-1 proximal to the interior surface 139. Rotating the impeller/slinger assembly 112 may further cause the fluid, e.g., received from the impeller 136, along with the additive received through the additive inlet 110, to be slung radially outward. In an example, the outward slinging may be caused by the slinger 134 of the impeller/slinger assembly 112, which may include blades 138 and/or disks 202. Further, the slinger 134 may include an inlet face 134-1, which may, for example, be oriented toward the additive inlet 110. When the additive is fed through the additive inlet 110, the additive may impinge on the blades 138 and/or disks 202 and be slug radially outward The combination of the impeller 136 and the slinger 134, e.g., in a back-to-back configuration, may result in an eye defined by a hydrodynamically-stable fluid-air boundary, to develop in the slinger 134. For example, the boundary may be present radially between a hub 138-1 and tip 138-2 of the blades 138 of the slinger 134. The slinging of the additive (as well as the fluid received from the impeller 136) radially outwards by action of the slinger 134 may result in the additive crossing the air-fluid boundary, and thus being at least partially dispersed into the fluid, thereby forming a slurry. In some cases, the action of the impeller/slinger assembly 112 may create a hydrodynamically-stable eye, forming a fluid-air boundary, thereby preventing air from becoming entrained in the fluid. However, in some cases, air may be purposely introduced into the mixture, for example, in foaming applications, e.g., using the stator 120 of FIG. 8.

The additive may further be dispersed in the fluid, promoting increased homogenization of the slurry, by the slurry being received through the stator 120, as at 1008. Various embodiments of the stator 120 are discussed above, e.g., with the first and second annular portions 146, 148 provided to minimize and maximize fluid shearing, respectively. In general, the stator 120 may include the plurality of vanes 156, defining flowpaths therebetween, through which the slurry is received. The interaction of the swirled, turbulent flow of the slurry with the stator vanes 156 may result in increased shearing of the fluid, which may increase mixing efficiency of the mixer 104. Once mixed to a desired degree, the slurry with a certain concentration of additives may be expelled from the mixer 104, as at 1010, via the outlet 121, which may be disposed radially outwards of the impeller/slinger assembly 112.

The method 1000 may also include, e.g., as caused by rotation of the impeller/slinger assembly 112 at 1006, a portion of the fluid or slurry (e.g., with a relatively low concentration, relative to flow through the outlet 121) to flow into the flush line 122 and to the additive inlet 110, to pre-wet the additive, as at 1012. For example, the flush line 122 may include the opening 140, which may be positioned and/or sized so as to receive a slurry with a predetermined (e.g., minimized) concentration of additives at a predetermined (e.g., maximized) pressure in the mixing chamber 118. The sizing of the flush line 122, placement of the opening 140 thereof, and/or employment of flow control devices in the flush line 122, etc. may allow control of the amount of fluid that proceeds through the flush line 122 and the composition thereof.

It will be appreciated that terms implying a direction or an orientation, e.g., "up," "down," "upwards," "downwards," "above", "below," "laterally," and the like are employed merely for convenience to indicate relative positioning of the components with respect to each other, as depicted in the various figures. One of ordinary skill in the art will appreciate that these terms are not intended to limit the mixer 104 to any particular orientation, however.

Further, while the present teachings have been illustrated with respect to one or more embodiments, alterations and/or modifications may be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." Further, in the discussion and claims herein, the term "about" indicates that the value listed may be somewhat altered, as long as the alteration does not result in nonconformance of the process or structure to the illustrated embodiment. Finally, "exemplary" indicates the description is used as an example, rather than implying that it is an ideal.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. A method for dispersing an additive in a fluid, comprising:

feeding a fluid to a fluid inlet of a mixer, wherein the fluid inlet extends through an interior surface defining a bottom of a mixing chamber of the mixer to a centrally-disposed opening of the fluid inlet below an impeller/slinger assembly disposed in the mixing chamber;

feeding an additive to an additive inlet of the mixer above the impeller/slinger assembly, wherein the additive inlet is separate from the fluid inlet;

rotating the impeller/slinger assembly wherein rotating the impeller/slinger assembly draws fluid from the fluid inlet, expels the fluid radially outward, slings the additive radially outward into the fluid so as to generate a slurry comprising the additive and the fluid as the additive and the fluid flow through a stator disposed radially around the impeller/slinger assembly, and directs the generated slurry toward a fluid outlet disposed radially outward from the impeller/slinger assembly and the stator, wherein the stator comprises a first annular portion comprising a first shroud having a plurality of posts that define a plurality of slots and a second annular portion comprising a second shroud having a plurality of stator vanes that define a plurality of flow paths, and wherein the additive and the fluid flow through the plurality of slots and the plurality of flow paths;

delivering a relatively clean portion of the fluid from an opening of a flush line to an additive receiving structure without additional pumping devices between the opening of the flush line and the additive receiving structure, wherein the opening of the flush line is adjacent to the impeller/slinger assembly below the impeller/slinger assembly, wherein the entire flush line is separate from the fluid outlet and the fluid inlet, and wherein additive receiving structure is adjacent to the additive inlet of the mixer above the impeller/slinger assembly; and pre-wetting the additive upstream of the mixing chamber by introducing the relatively clean portion of the fluid from the flush line into the mixer.

2. The method of claim 1, further comprising:

selecting a percentage of the fluid received through the fluid inlet; and controlling fluid flow through the flush line such that approximately the percentage of the fluid is received into the additive inlet via the flush line.

3. The method of claim 2, wherein controlling the fluid flow comprises:

selecting a position for the flush line opening of the flush line relative to an impeller of the impeller/slinger assembly and the fluid inlet via the flush line.

4. The method of claim 3, further comprising:

selecting a composition of the fluid received through the fluid inlet; and positioning the flush line opening of the flush line relative to the impeller of the impeller/slinger assembly and the fluid inlet, such that the fluid received therein comprises approximately the composition.

5. The method of claim 1, further comprising:

selecting a location for the flush line opening of the flush line based on a tradeoff between cleanliness and pressure of the fluid in the mixing chamber.

6. The method of claim 1, further comprising:

wherein introducing comprises delivering the relatively clean portion of the fluid from the flush line to an inner surface of an additive-receiving structure of the additive inlet; and channeling the fluid along the inner surface toward the mixing chamber.

7. The method of claim 6, wherein delivering the fluid from the flush line to the inner surface of the additive-receiving structure comprises delivering the fluid on a trajectory that is substantially tangent to the inner surface of the additive-receiving structure.

8. The method of claim 1, wherein pre-wetting the additive minimizes clumping of the additive on a surface of the mixer.

9. The method of claim 6, wherein delivering comprises forming a wall of fluid along the inner surface of the additive receiving structure.

10. The method of claim 1, wherein introducing comprises introducing the relatively clean portion of the fluid from the flush line into the mixing chamber without the use of a separate pump, thereby enabling the dispersing of the additive into the fluid to be self-regulating.

11. The method of claim 1, wherein the relatively clean portion of the fluid comprises fluid having a low concentration of additives therein.

12. The method of claim 1, wherein delivering comprises delivering the relatively clean portion of the fluid utilizing a pressure in the mixing chamber.

13. The method of claim 12, wherein utilizing a pressure in the mixing chamber comprises utilizing high pressure fluid from the mixing chamber and delivering the high pressure fluid to an ambient pressure at the additive receiving structure.

14. A mixer, comprising:

a housing comprising a fluid inlet, an additive inlet, and a fluid outlet, the housing defining a mixing chamber in fluid communication with the fluid inlet, the additive inlet, and the fluid outlet, wherein the additive inlet is separate from the fluid inlet;

an impeller disposed in the mixing chamber, wherein, when rotated, the impeller pumps fluid through the fluid inlet, wherein the fluid inlet extends through the housing to a centrally-disposed opening of the fluid inlet below the impeller;

a slinger disposed in the mixing chamber and configured to receive the fluid from the impeller and to receive an additive from the additive inlet above the slinger, wherein, when rotated, the slinger slings the fluid and the additive radially outwards toward the fluid outlet;

a stator disposed radially around the impeller and the slinger, wherein the stator comprises a first annular portion comprising a first shroud having a plurality of posts that define a plurality of slots and a second annular portion comprising a second shroud having a plurality of stator vanes that define a plurality of flow paths, and wherein the additive and the fluid flow through the plurality of slots and the plurality of flow paths; and a flush line separate from the fluid outlet, the flush line extending between the mixing chamber and the additive inlet, wherein the flush line is configured to receive, from an opening below the impeller, a portion of the fluid pumped by the impeller and to deliver the portion of the fluid to the additive inlet without additional pumping devices between the opening in the housing and the additive inlet, to pre-wet the additive received through the additive inlet, the opening extending through an interior surface defining a bottom of the mixing chamber.

15. The mixer of claim 14, wherein the additive inlet comprises an additive-receiving structure extending from the housing and configured to channel the additive toward the slinger.

16. The mixer of claim 15, wherein the flush line delivers fluid to the additive-receiving structure.

17. The mixer of claim 16, wherein the flush line comprises an outlet oriented to deliver the portion of the fluid at a trajectory that is substantially tangent to the additive-receiving structure.

18. The mixer of claim 17, wherein the additive-receiving structure comprises a cone.

19. The mixer of claim 14, wherein the flush line comprises an opening defined in the housing, wherein the opening is disposed radially outward, with respect to the impeller, from the fluid inlet.

20. The mixer of claim 19, wherein the housing defines an interior surface, the fluid inlet and the opening of the flush line being defined in the interior surface.

21. The mixer of claim 20, wherein the portion of the fluid is pushed through the flush line via a pressure differential between the opening and the additive inlet, such that the flush line is free from pumping devices.

* * * * *